US007252209B2

(12) United States Patent
Julius

(10) Patent No.: US 7,252,209 B2
(45) Date of Patent: Aug. 7, 2007

(54) INVERTED WET WIPE DISPENSER

(75) Inventor: Robert P. Julius, Greenwich, CT (US)

(73) Assignee: Nice-Pak Products, Inc., Orangeburg, NY (US)

( * ) Notice: Subject to any disclaimer, the term of this patent is extended or adjusted under 35 U.S.C. 154(b) by 0 days.

(21) Appl. No.: 10/792,067

(22) Filed: Mar. 3, 2004

(65) Prior Publication Data

US 2005/0194395 A1 Sep. 8, 2005

(51) Int. Cl.
*B65H 1/00* (2006.01)

(52) U.S. Cl. ..... 221/33; 221/45; 221/46; 221/150 A; 221/285; 221/286

(58) Field of Classification Search ..... 221/33, 221/45, 46, 150 A, 284, 285, 286; 248/128, 248/146, 154, 176.1, 177.1, 187.1, 309.1, 248/311.2, 311.3, 346.04, 346.03
See application file for complete search history.

(56) References Cited

U.S. PATENT DOCUMENTS

| | | | | | |
|---|---|---|---|---|---|
| 4,694,973 | A * | 9/1987 | Rose et al. | ..... | 221/46 |
| 4,699,371 | A * | 10/1987 | Ettischer et al. | ..... | 271/99 |
| 4,735,317 | A * | 4/1988 | Sussman et al. | ..... | 206/449 |
| 5,100,020 | A * | 3/1992 | Petterson et al. | ..... | 221/45 |
| 5,210,396 | A | 5/1993 | Sanders | | |
| 5,215,211 | A * | 6/1993 | Eberle | ..... | 221/1 |
| 5,542,568 | A | 8/1996 | Julius | | |
| 5,647,506 | A | 7/1997 | Julius | | |
| 5,950,863 | A * | 9/1999 | Schutz et al. | ..... | 221/46 |
| 6,179,162 | B1 * | 1/2001 | Motsenbocker | ..... | 221/150 A |
| 6,189,730 | B1 * | 2/2001 | McClymonds | ..... | 221/46 |
| 6,331,696 | B1 | 12/2001 | Nakamura et al. | | |
| 6,364,156 | B1 * | 4/2002 | Smith et al. | ..... | 221/46 |
| 6,412,634 | B1 | 7/2002 | Telesca et al. | | |
| 6,431,360 | B1 * | 8/2002 | Julius | ..... | 206/494 |
| 6,578,731 | B1 | 6/2003 | Lewis et al. | | |
| 6,585,130 | B2 | 7/2003 | Turbett et al. | | |
| 2003/0062375 | A1 * | 4/2003 | Christensen et al. | ..... | 221/46 |

FOREIGN PATENT DOCUMENTS

| | | |
|---|---|---|
| JP | 8-117137 | 5/1996 |

* cited by examiner

*Primary Examiner*—David H. Bollinger
(74) *Attorney, Agent, or Firm*—Lerner, David, Littenberg, Krumholz & Mentlik, LLP

(57) ABSTRACT

A wet wipe dispenser is provided that includes a support having an open area adapted to be juxtaposed with the cover portion of a container of wet wipes in an inverted orientation, and a base portion supporting the support above a surface on which the base portion is placed. In one embodiment the wet wipes dispenser includes a lower support and an upper support connected by means of a hinge. A wipes package is inserted between the upper and lower supports in juxtaposition with a slot within the lower support. The package has an inverted orientation within the slot such that wipes are downwardly dispensed, which allows for removal, and preferably also heating of the wipes, without a high rate of moisture loss occurring from the package. The downward force of the upper support can compress the package as wipes are sequentially dispensed.

85 Claims, 12 Drawing Sheets

INVERTED WET WIPE DISPENSER

FIELD OF THE INVENTION

The present invention relates to dispensers for wet wipes. More particularly, the present invention relates to dispensers for heated wet wipes. More particularly, the present invention relates to dispensers for heated baby wipes and the like.

BACKGROUND OF THE INVENTION

Wet wipes have become a staple article of commerce in connection with their use for numerous cosmetic, personal and household applications, including use as baby wipes and the like. The packaging and dispensing of wet wipes has developed in numerous directions including portable dispensers, both hard and soft containers, and many dispensers which are available in different shapes, size and forms, both heated and unheated. In a number of these dispensers the accessiblity of the wipes themselves is not readily obtained, and in many of these applications, such as with various pop-up dispensers, even though these dispensers are designed and intended to be used for the individual removal of these wipes, the first available wet wipe tends to dry out, particularly when not subject to immediate use. This, in turn, eliminates the entire purpose of wet wipes, producing dryer, less comfortable and less efficient products.

In many cases these wet wipes are sold in containers, including both flexible and rigid containers, and the solvent or other liquid contained within the wet wipes is unevenly distributed in these containers. Thus, the wipes at the bottom of the container are far wetter than the wipes at the top of the container, and in fact in some cases users have tended to invert the containers and leave them in that condition for a period of time in order to more evenly distribute this liquid throughout the container.

In addition, in many of these wet wipe dispensers, and particularly the pop-up dispensers, although they are specifically designed so that with the removal of each wet wipe the next succeeding wet wipe will be pulled into a dispensing slot for subsequent removal, during use in many case the initial wet wipe will fall back into the container, thus creating inconvenience, and the need for manual manipulation in order to obtain the upper wet wipe and withdraw it into the dispensing slot.

The nature and variety of various wipe dispensers is, as mentioned above, quite extensive. Examples by the assignee of the present application include U.S. Pat. Nos. 5,647,506 and 5,542,568, which are only two of the many commercially important products which have been developed. These also include products with refillable dispensing systems, such as in U.S. Pat. No. 6,412,634, and systems which dispense continuous webs of material which are joined by perforations and are dispensed from a continuous roll such as those described in U.S. Pat. No. 6,578,731, and others.

There are also some instances in which dry wipe dispensers have been designed for downward removal of an initial wipe from a vertically disposed wipe dispenser kit. Thus, the product shown in U.S. Pat. No. 6,585,130 is mounted by means of a hook attached to an outside surface. However, the product shown in this patent is specifically designed for the dispensing of dry wipe products, and the wipes are not arranged to be separately removed through a dispensing slot. To the contrary, they are specifically arranged for grasping by the user in order to effectuate each separate removal step. Also, this device is not removably or temporarily mountable upon a surface for the ready removal of individual wipes therefrom, and in fact the bottom surface includes the slot for wipe removal and therefore could not possibly be mounted on a surface selected by the user.

In addition, there are a number of heated wipe dispensers which are known in the art in which the wipes are separately removed in an upward direction from the top of a dispenser. For example, Japanese Patent No. JP 8-11737 (see FIG. 13 of U.S. Pat. No. 6,331,696) discloses a prepackaged wet tissue warming apparatus with electrical heating elements heating the wet tissues closest to the dispensing surface so as to provide for those tissues to be heated more thoroughly than those further from the dispensing surface. The surface also includes a cover which can be opened to remove the wet tissues and means for aiding in dispensing by utilizing coil springs to exert pressure upon the plate supporting the wet tissues.

There are many other configurations of wet wipes and the like which are disposed in a heated dispenser for upward removal in the prior art. These include, for example, the aforementioned U.S. Pat. No. 6,331,696, disclosing a device for warming prepackaged pre-wetted towels including a coil spring shown in FIG. 2 thereof to aid in dispensing. Also, U.S. Pat. No. 4,694,973 uses light bulbs as the heating element therein, and U.S. Pat. No. 5,210,396 discloses a baby wipes warmer apparatus which includes a container assembly to receive a box of baby wipes and a heater assembly with an electrical heating element with preselected heating conditions.

The search has thus continued for a more convenient and efficient dispenser for wet wipes which can not only provide a free-standing dispenser which is readily usable for individual selective removal of wet wipes when mounted on a surface selected by the user, but which also maintains these wet wipes in a configuration which keeps the leading wet wipe for removal in a wet or moist condition while permitting such ready removal, and which in a preferred embodiment also provides for heating the wet wipes as they are removed from the container, which is also preferably one which can be refilled in a simple manner.

SUMMARY OF THE INVENTION

In accordance with the present invention, these and other objects have now been realized by the invention of a dispenser for wet wipes stacked within a container having a top surface, a raised portion having predetermined dimensions and including a dispensing opening for individual removal of the wet wipes, the dispenser comprising a support member having an open area, whereby the top surface of the container can be juxtaposed with the support member with the raised portion maintained within the open area, the base portion supporting the support member with respect to a selected surface on which the base member is mounted, whereby the wet wipes can be individually removed from the container through the open area of the support member and each of the wet wipes is maintained in a moist condition. Preferably, the wet wipes can be individually removed in a generally horizontal or downward direction, and more preferably in a generally downward direction. In one embodiment, the base portion is disposed below the support member, whereby the selected surface comprises a substantially horizontal surface. In another embodiment, the base portion is disposed adjacent to the support member, whereby the selected surface comprises a substantially vertical surface. Preferably, the open area has dimensions substantially corresponding to the predetermined dimensions. More preferably, the support member comprises a first support member portion and includes a second support member portion substantially perpendicular to the first support member portion, whereby the container can be retained in position between the first support member portion and the second support member portion.

In accordance with one embodiment of the dispenser of the present invention, the support member and the base portion have a unitary construction.

In accordance with another embodiment of the dispenser of the present invention, the dispenser includes at least one heater for maintaining the wet wipes at a predetermined temperature. Preferably, the dispenser also includes a thermostat for controlling the at least one heater.

In accordance with one embodiment of the dispenser of the present invention, the at least one heater is disposed in the support member.

In accordance with another embodiment of the dispenser of the present invention, the at least one heater comprises a resistance heater.

In accordance with another embodiment of the dispenser of the present invention, the at least one heater comprises a first heater portion on one side of the open area and a second heater portion of a second side of the open area.

In accordance with another embodiment of the dispenser of the present invention, the dispenser includes actuation means for actuating the heater. Preferably, actuation means comprises a switch. More preferably, the switch is disposed in the support member. In a preferred embodiment, the switch is disposed at a location extending into the open area, whereby the presence of the raised portion of the container in the open area actuates the switch.

In accordance with one embodiment of the dispenser of the present invention, the first and second heater portions comprise a plurality of heating coils.

In accordance with a preferred embodiment of the dispenser of the present invention, the second support member comprises a substantially rectangular configuration comprising four wall members for substantially surrounding the container.

In accordance with another embodiment of the dispenser of the present invention, the raised portion of the container includes a closable lid for sealing the dispensing opening. Preferably, the closable lid comprises a substantially rigid plastic material.

In accordance with the present invention, a dispensing system for wet wipes is also disclosed comprising a container including a stacked plurality of wet wipes and having a top surface including a raised area having a predetermined dimension and including a dispensing opening for individual removal of the wet wipes from the container, and a dispenser comprising a support member having an open area whereby the top surface of the container can be juxtaposed with the support member with the raised portion maintained within the open area, and a base portion supporting the support member with respect to a selected surface on which the base portion is mounted, whereby the wet wipes can be individually removed from the container through the open area of the support member and each of the wet wipes is maintained in a moist condition. Preferably, the individual wet wipes can be removed in a generally horizontal or downward direction, and more preferably in a generally downward direction. In one embodiment, the base portion is disposed below the support member, whereby the selected surface comprises a substantially horizontal surface. In another embodiment, the base portion is disposed adjacent to the support member, whereby the selected surface comprises a substantially vertical surface. In a preferred embodiment, the open area has dimensions substantially corresponding to the predetermined dimensions.

In accordance with the present invention, a dispenser for wet wipes stacked within a container having a top surface and a dispensing opening for individual removal of the wet wipes from the container is also disclosed, the dispenser comprising a first member facing generally downwardly and including an open area, a second member above the first member whereby the container can be disposed between the first member and the second member with the dispensing opening in the container juxtaposed with the open area of the first member, and a hinge member interconnecting the first member with the second member for exerting pressure on the container disposed between the first member and the second member, whereby the wet wipes can be individually removed in a generally downward direction from the container through the open area of the first member and moisture within the container is caused to flow towards the open area to moisten each of the individually removed wet wipes. In a preferred embodiment, the dispenser includes pressure means, such as a spring member acting on the second member for urging the second member towards the first member, whereby as the wet wipes are individually removed from the container and the container reduces in size, the second member remains in contact with and exerts pressure on the container.

In accordance with one embodiment of the dispenser of the present invention, the first member includes a first portion including the open area and a second portion substantially perpendicular to the first portion, whereby the container can be retained in position between the first and second portions of the first member. Preferably, the dispenser includes a base portion supporting the first member. In a preferred embodiment, the base portion and the first member have a unitary construction.

In accordance with another embodiment of the dispenser of the present invention, the dispenser includes at least one heater for maintaining the wet wipes at a predetermined temperature. Preferably, the dispenser includes a thermostat for controlling the at least one heater. In one embodiment, the at least one heater is disposed in the first member. In another embodiment, the at lest one heater comprises a resistance heater. Preferably, the at least one heater comprises a first heater portion on one side of the open area and a second heater portion on a second side of the open area.

In accordance with another embodiment of the dispenser of the present invention, the dispenser includes activation means for activating the heater. Preferably, the activation means comprises a switch. In a preferred embodiment, the switch is disposed in the first member. Preferably, the switch is disposed at a location extending into the open area, whereby the presence of the container in the dispenser activates the switch.

In accordance with another embodiment of the dispenser of the present invention, the open area comprises a slot in the first member. Preferably, the first and second heater portions comprise a plurality of heating coils.

In accordance with the present invention, a dispensing system has also been discovered for wet wipes comprising a container including a stacked plurality of wet wipes including a top portion having a dispensing opening for individual removal of the wet wipes from the container, and a dispenser comprising a first member facing generally downwardly including an open area, the container disposed on the first member with the top portion of the container in contact with the first member and the dispensing opening juxtaposed with the open area of the first member, a second member disposed above the first member, with the container disposed between the first member and the second member, and a hinge member interconnecting the first member with the second member for exerting pressure on the container, whereby the wet wipes can be removed in a generally downward direction through the open area of the first member and moisture within the container is caused to flow towards the open area to moisten each of the individually removed wet wipes. Preferably, the dispensing system includes pressure means, such as a spring member acting on the second member for urging the second member towards the first member, whereby as the wet wipes are individually removed from the container and the container reduces in size, the second member retains contact with and pressure on the container. Preferably, the first member includes a first portion including the open area and a second portion substantially perpendicular to the first portion, whereby the container can be retained in position between the first and second portions of the first member. In a preferred embodiment, the dispensing system includes a base portion supporting the first member. Preferably, the base portion and the first member comprise a unitary construction.

In accordance with one embodiment of the dispensing system of the present invention, the dispensing system includes at least one heater for maintaining the wet wipes at a predetermined temperature. Preferably, the dispensing system includes a thermostat for maintaining the heater at the predetermined temperature. In a preferred embodiment, the at least one heater is disposed in the first member.

In accordance with a preferred embodiment of the dispensing system of the present invention, the at least one heater comprises a resistance heater. In one embodiment, the at least one heater comprises a first heater portion on one side of the open area and a second heater portion on the second side of the open area. In another embodiment, the dispensing system includes actuating means for actuating the heater. Preferably, the actuating means comprises a switch. In a preferred embodiment, the switch is disposed in the first member. Preferably, the switch is disposed at a location extending into the open area, whereby the presence of the container in the dispenser actuates the switch.

In accordance with one embodiment of the dispensing system of the dispensing system of the present invention, the open area comprises a slot in the first member.

In accordance with another embodiment of the dispensing system of the present invention, the first and second heater portions comprise a plurality of heating coils.

BRIEF DESCRIPTION OF THE DRAWINGS

The present invention may be more fully appreciated with reference to the following detailed description, which, in turn, refers to the figures in which.

DETAILED DESCRIPTION

Figure 1:
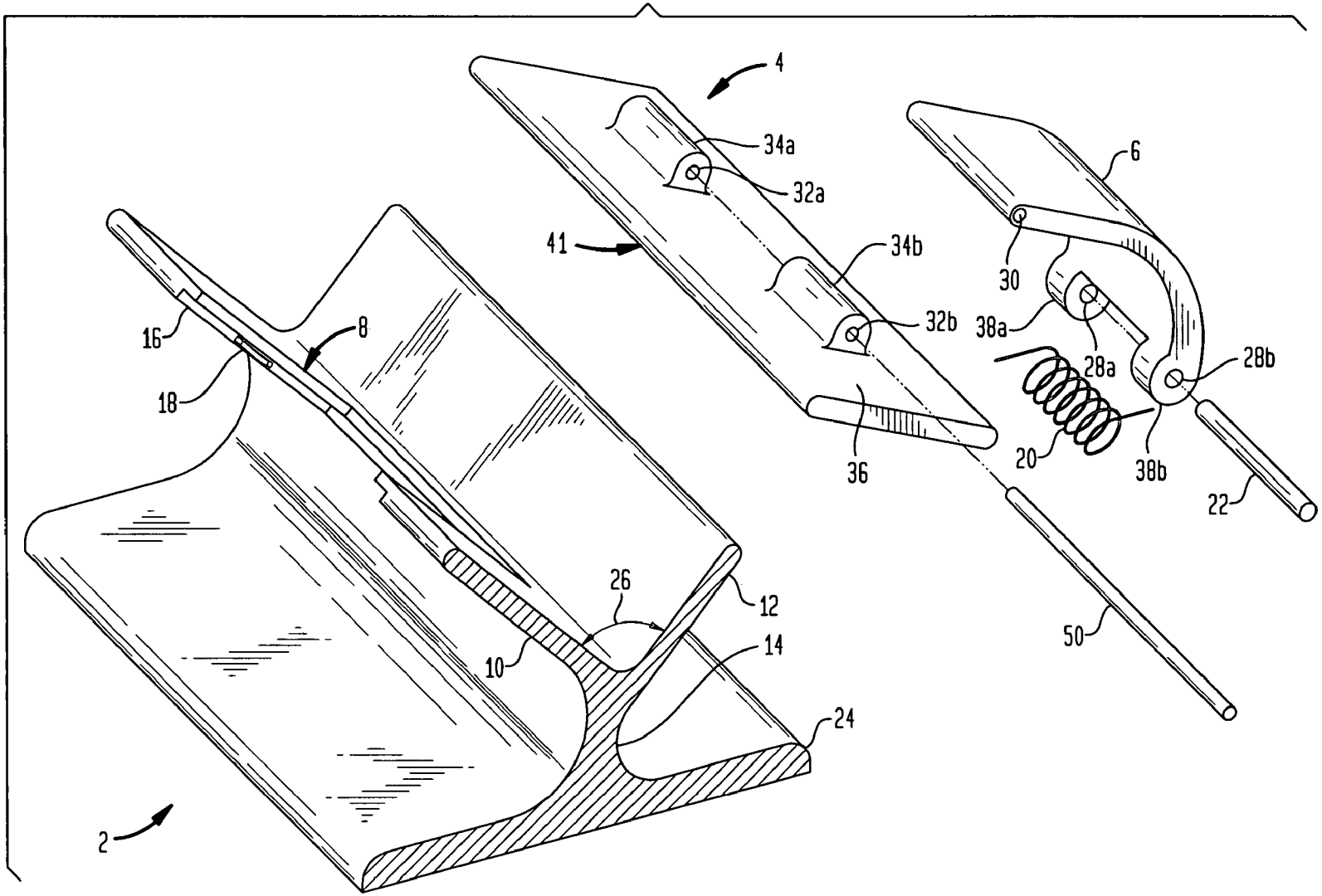
FIG. 1 is a side, perspective, exploded view of a dispenser system in accordance with the present invention.

Referring to the figures, in which like reference numerals in the various drawings refer to like elements therein, FIG. 1 shows an embodiment of the dispenser of the present invention. The wet wipe dispenser shown in FIG. 1 in an exploded view includes a first member 10 which is preferably planar, and which essentially acts as a platform for a container of wet wipes which will be removably placed thereon.

Figure 1A:
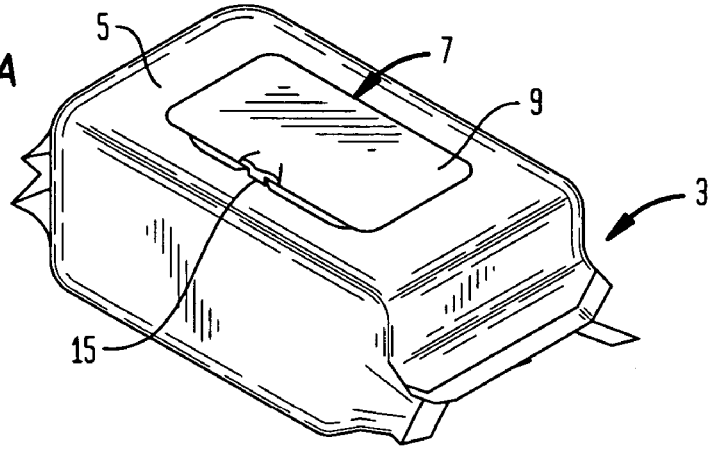
FIG. 1*a* is a side, perspective view of a flexible container for use in connection with the dispenser system of the present invention.
Figure 1B:
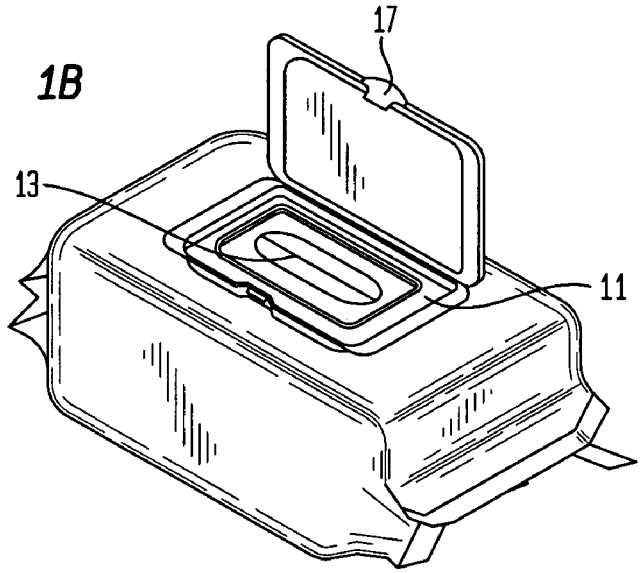
FIG. 1*b* is side, perspective view of the container shown in FIG. 1*a* with the rigid plastic cover in the open position.
Figure 1C:
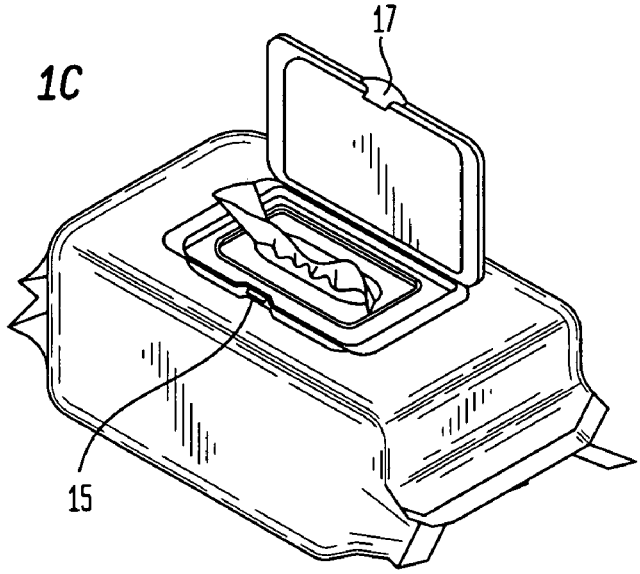
FIG. 1*c* is a side, perspective view of the container shown in FIG. 1*b* with the initial wet wipe in the use position extending from the dispensing opening.

A typical container of wet wipes for use in connection with the dispenser of the present system is shown in FIGS. 1*a-c*. As shown in FIG. 1*a*, a preferred container 3 includes a body which is generally produced from flexible plastic-based packaging material such as poly bags and the like. The packaging material for the container 3 thus forms a complete package for the wet wipe product contained within the package. On the upper surface 5 of the container 3, however, an enclosure 7 for sealing the top 5 of the container 3 is provided. The enclosure 7 is preferably made of a more durable material than the product packaging itself, and is preferably a hard plastic suitable for repeated use in consumer product packaging. The enclosure 7 includes a cover member 9 hingedly attached to a framed base 11 physically affixed to the top 5 of the container 3. The framed base 11 is preferably physically affixed or bonded to the product packaging itself by means of an adhesive, preferably a permanent adhesive, so that the base surrounds an area in which a dispensing opening 13 is provided into the container 3. The surrounding base 11 thus forms a seal along its perimeter with the packaging material itself to preserve the product contained within the product packaging. The cover 7 is again coupled to the surrounding base 11 by means of a hinge such as a living hinge, and can be locked to the base upon its closure by means of a locking tab 15 that interfaces with a corresponding locking flange 17 on the cover 7. The cover 7 is designed so that the cover 7 and the surrounding base 11 are capable of forming a substantially airtight seal when closed to preserve the product in the package while at the same time the cover 7 can be readily opened from the surrounding base 11 by lifting locking tab 17. The airtight seal is at least sufficiently sealed to prevent spoilage of the products within the container such as wet wipes. As can be see in FIG. 1*c*, when the lid 7 is opened, the initial wet wipe can be removed through the dispensing opening 13 and retained in position thereby, even if the cover 7 is closed as in FIG. 1*a*.

The first member 10 in the embodiment shown in FIG. 1 is part of the unitary lower member 2 which includes the first member 10 and supports it above a support surface, such as a table, furniture, or the like. The lower member 2 thus includes a base 24 which supports the entire lower portion 2 above that surface on which base 24 can rest. The lower member 2 includes a neck portion 14 extending from the base 24, and supporting the first member 10. The neck portion 14 also supports a second member 12 which extends substantially perpendicularly with respect to the first portion 10. In this manner, the removable container of wet wipes, such as container 3 in FIG. 1*a*, can be placed and supported on the lower member 2 between the first member 10 and the second member 12 as can be seen, for example, in FIGS. 4-7 which are discussed in more detail below.

As can be seen in FIG. 1, the first member 10 in this embodiment is not horizontal, but is disposed at an angle with respect to the surface on which the base 24 is supported. Thus, the angle between base 24 and first member 10 should generally be between about 0° and about 75°, or possibly even greater (see discussion below with respect to FIG. 12). Thus, in some embodiments the angle can be up to 90°; i.e., where the wet wipes are withdrawn horizontally. However, when the angle is less than 90°, preferably between 0° and about 70°, the wet wipes mounted on first member 10 will be facing in a generally downward direction for individual removal therefrom. For this purpose, the first member 10 includes a slot 8, or an open area, through which the wet wipes can be dispensed. Thus, the wet wipe container is mounted on the lower member 2 with the top portion of the wet wipe container which includes an opening for the wet wipes to be removed facing generally downwardly, and in juxtaposition with the open area or slot 8, again as shown in FIGS. 4-7.

The dispenser shown in FIG. 1 also includes an upper member 4 which is intended to be placed on the bottom side of the container of wet wipes when it is mounted on the lower member 2. The upper member 4 thus includes a generally planar configuration having a bottom surface 41 for contact with the bottom surface of the container or package of wet wipes which it is mounted on the lower member 2.

The lower member 2 and the upper member 4 are also connected to each other. In the embodiment shown in FIG. 1, this is accomplished by means of a hinge or arm 6 which is attached at its one end to the upper member 4 and at its other end to the lower member 2.

Figure 2A:
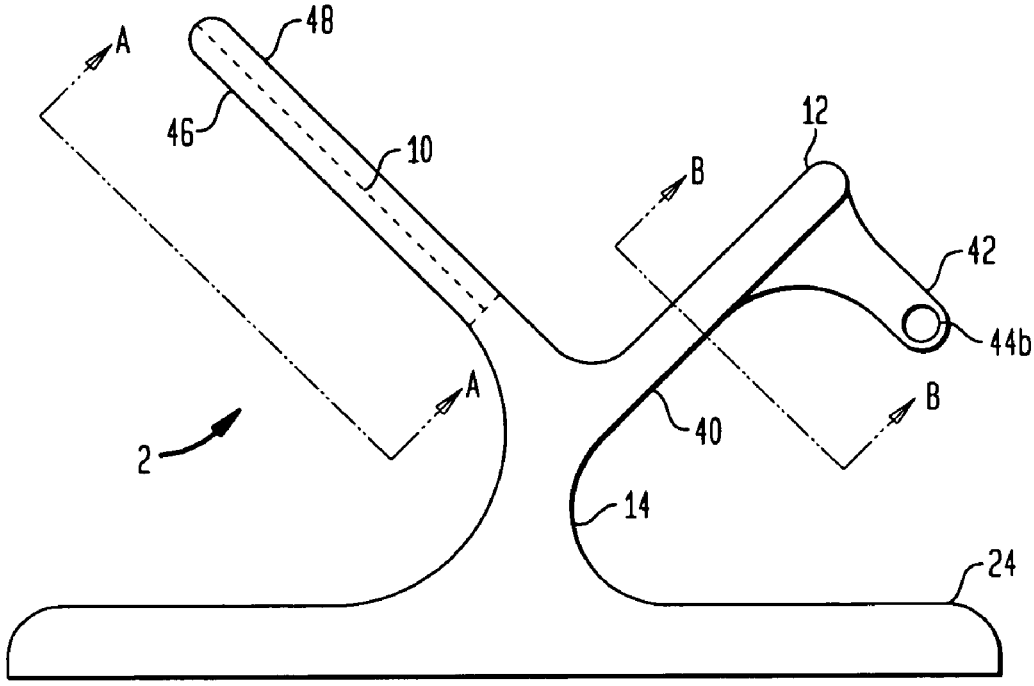
FIG. 2*a* is a side, elevational view of a base portion of the dispenser system shown in FIG. 1.

As can be seen in FIG. 2*a*, on the rear surface 40 of the second portion 12, there is a projecting extension 42. Furthermore, on the upper surface 36 of the upper member 4 are extensions 34*a* and 34*b*. The extensions 42*a* and 42*b* (see FIG. 2*b*) on the bottom surface of the second portion 12 of the lower member 2 include openings 44*a* and 44*b*, and the extensions 34*a* and 34*b* on the upper surface 36 of the upper member 4 include cylindrical openings 32*a* and 32*b* extending therethrough. The hinge or arm 6 includes an arcuate surface. At the upper end of hinge 6, a bore 30 extends through the end portion of the hinge 6. At the lower end of the hinge 6 extensions 38*a* and 38*b* each include a bore 28*a* and 28*b*, respectively. In this manner, the hinge can be attached to the upper member 4 and the lower member 2. By aligning bores 44*a* and 44*b* which are affixed to the bottom surface 40 of the second portion 12 of the lower member 2 with corresponding bores 28*a* and 28*b* at the lower end of the hinge 6, a pivot pin 22 can be extended through these holes to pivotally attach these two members. Similarly, by aligning the bore 30 at the upper end of hinge 6 with the corresponding bores 32*a* and 32*b* extending through extensions 34*a* and 34*b* located at the top surface 36 of the upper member 4, a similar pivot pin 50 can be extended through these bores to pivotally attach the upper end of the hinge 6 to the upper surface 36 of the upper member 4.

In a preferred embodiment, a torsion spring 20 can be affixed to the lower portion of the hinge 6 so as to pivotally urge the upper end of the hinge 6 downwardly against the upper surface of the upper member 4 such as by merely surrounding the pivot pin 22, so that the hinge 6 will cause the upper member 4 to exert pressure on the bottom surface of the container of wet wipes disposed between the upper member 4 and the lower member 2.

Figure 2B:
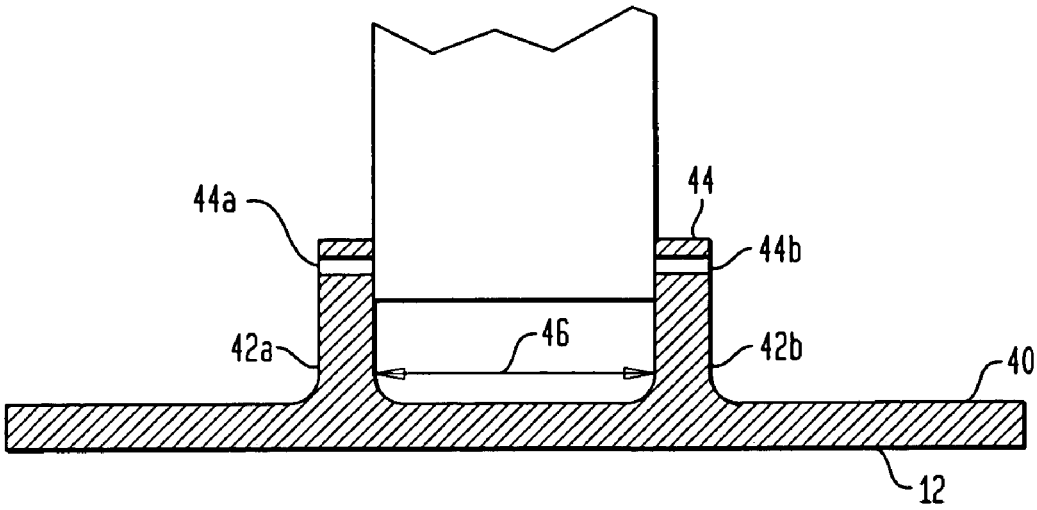
FIG. 2*b* is a front, elevational, partially sectional view of a portion of the upper portion of the dispensing system shown in FIG. 1.

As can be specifically in FIG. 2*b*, which is a cross-sectional view of the portion of FIG. 2*a* represented by lines B-B, the extensions 42*a* and 42*b* are separated by a distance shown by arrow 46 which is sufficient to receive the entire width of the hinge 6 therebetween. Similarly, extensions 34*a* and 34*b* on the upper surface of upper member 4 are separated by a distance which is sufficient to accept the upper portion of hinge 6 therebetween. Specific placement of the torsion spring 20 would be to encircle the pivot pin 22 in its location between extensions 38*a* and 38*b* at the lower end of hinge 6.

Although this embodiment is shown with the use of pivot pins, there are a number of other alternative assemblies which can be used to an equivalent effect. For example, in one embodiment, a flexible strap can be secured to the upper member and the lower member, allowing both pivotable movement of the upper member relative to the lower member, as well as dynamic separation between the two members. Other such assemblies are also possible.

Figure 3A:
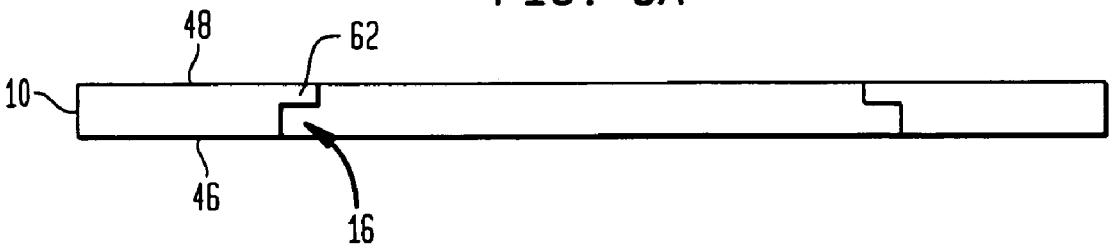
FIG. 3*a* is a front elevational, partial view of the first member of the dispensing system shown in FIG. 1.
Figure 3B:
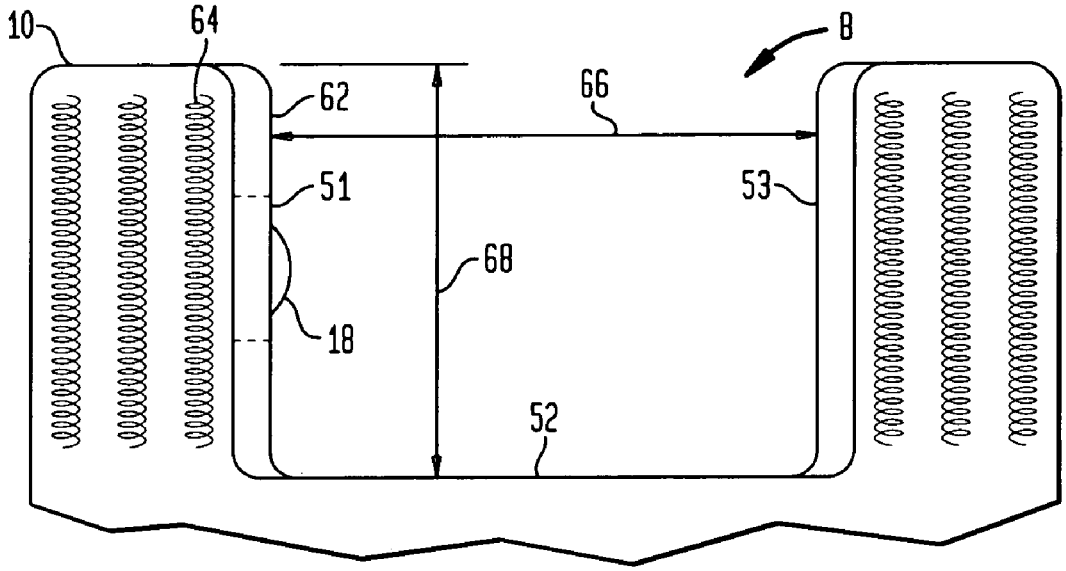
FIG. 3*b* is a bottom, elevational, partially schematic view of the portion of the first member of the dispensing system shown in FIG. 1.

Turning to FIG. 3*a*, it can be seen that the first portion 10 of the lower member 2 has an upper surface 48 and a lower surface 46. FIG. 3*b* shows a cross-sectional view taken along lines A-A thereof. It must be seen from FIGS. 3*a* and 3*b* that the first portion 10 includes a slot or open area 8 which is defined by the three sides of that open area, 51, 52 and 53. The cross-sectional view shown in FIG. 3*a* shows that the open area is further defined by a lip 62 defining a lower recessed portion 16. Lip 62 thus extends over a portion of the slot 8 and may extend around the entire periphery of that slot. In a preferred embodiment, the slot has a length 68 and a width 66 which allow for insertion of the dispensing portion of a standard wet wipe package.

Preferably, the length 68 and width 66 of the slot are such that the enclosure 7 on the top of the container 3 can fit within the slot 8, and preferably somewhat snugly in order to position and retain the container 3 in a proper position. The size of the slot 8 will thus preferably be such that the enclosure 3 is close enough to the sides of the slot 8 such that the material of the enclosure 7 can interact with the electrical switch 18 (see discussion below) which initiates the heater, also discussed below. Other slot dimensions are, however, anticipated depending upon the nature and substance of the particular wet wipe container which is to be disposed therein. Furthermore, slot 8 can be expandable or compressible allowing for compatibility of the dispenser of the present invention with more than one size wipe package.

In a preferred embodiment of the present invention, at least one heater 64 is imbedded, preferably within the first member 10, for the purpose of ensuring that the leading wet wipes, as they are individually removed from the dispenser, are not only properly moistened, but are also heated to the proper temperature. A number of such heater(s) can also be imbedded therein if desired. In general, the heaters are preferably symmetrically or asymmetrically distributed on the sides of the open area or slot 8, and may also be disposed on the upper surface 48 of the first portion 10, or on the opposing surface of first portion 10. Coiled resistance heaters are shown in FIG. 3*b* for this purpose. It should be understood, however, that a variety of other heaters could be used, such as pads, bars, rods, or other types of heaters, preferably resistance heaters of various kinds. Preferably, the heater has a range which is sufficient to maintain a temperature of between about 95 and 110° F. during operation. Preferably a thermostat or other type controller is connected to the heater to maintain either a constant temperature or a range of temperatures. The heater itself can be connected to various power sources, such as a line cord, batteries, or the like. Power sources thus include 120 volt AC outlets outfitting most homes in the United States, 250 volt AC outlets typical in European countries, DC power supplies, battery packs, and the like. Preferably, a timer is also included for controlling the heater as to the duration of heating.

In the embodiment shown in FIG. 1, an electrical switch 18 is disposed within the open area 8, and particularly mounted on the surface of the first portion 10 defining open area 8. Switch 18 is connected directly to heater 64, and the switch 18 also extends inwardly from the recessed area 16, past the lip 62, so that when a wet wipes or baby wipes package is inserted into the open area 8, the package will contact the switch 18, depress the switch and cause current to pass through heater 64. Heater 64 is preferably resistively heated, and the heat is thus transferred to the dispenser so that the package and its contents are appropriately warmed. The switch itself can be placed on any of the walls of the open area, or may be placed externally to the open area itself. For example, if a power cord is attached to heater 64, a switch can be placed anywhere along the length of the cord. In this manner, current will pass through heater 64 depending on the state of the switch; i.e., whether it is open or closed.

In another embodiment where a switch is not used, current can still be passed through heater 64 by means of a line cord when the cord is plugged into an electrical outlet regardless of whether a package is present within open area 8.

Figure 5:
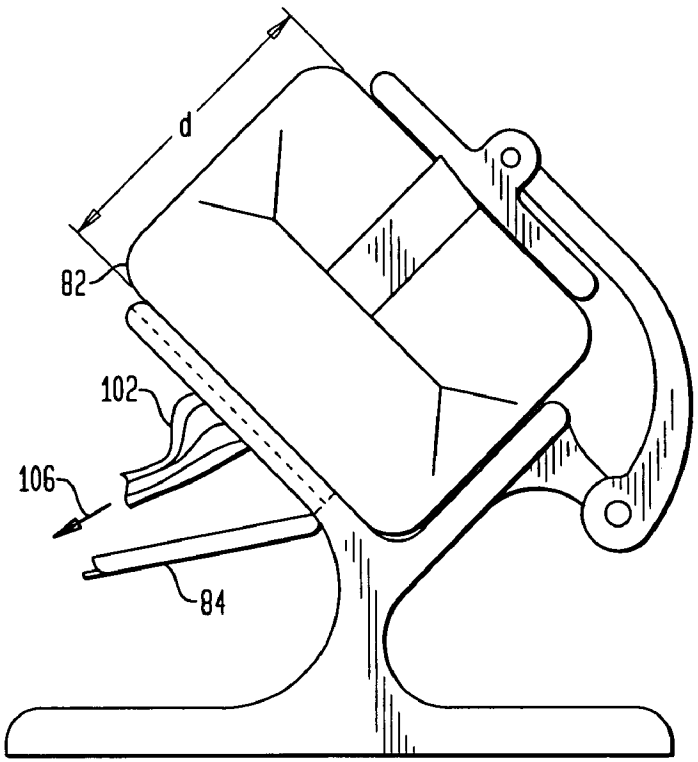
FIG. 5 is a side, elevational view of the dispensing system shown in FIG. 1 containing a package of disposable wet wipes.
Figure 4:
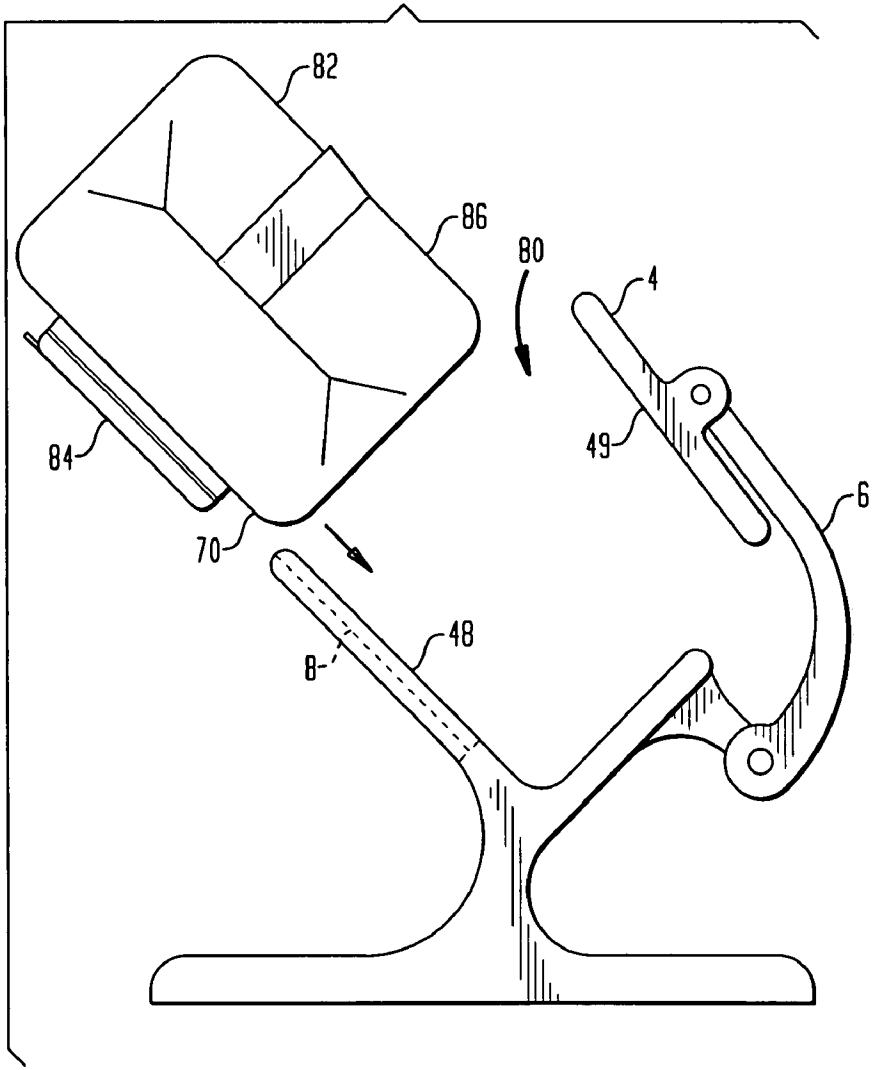
FIG. 4 is a side, elevational view of the dispenser shown in FIG. 1, accepting a disposable package of wipes.
Figure 7:
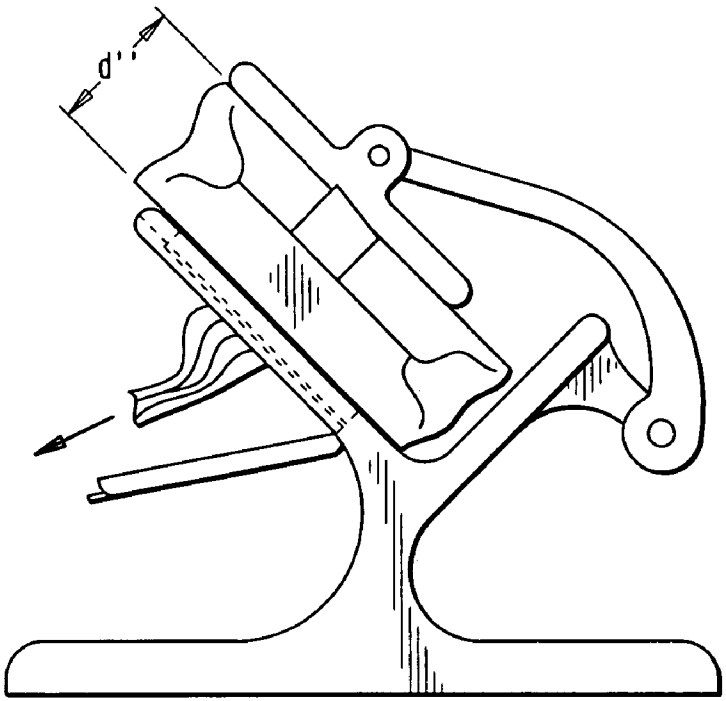
FIG. 7 is a side, elevational view of the dispenser shown in FIG. 1 after considerable use of the container of disposable wet wipes.
Figure 6:
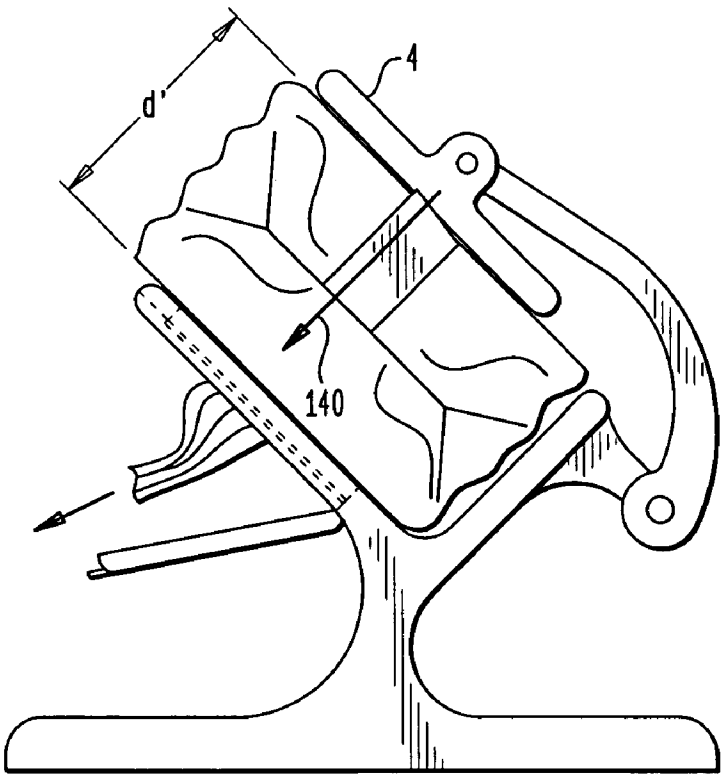
FIG. 6 is a side, elevational view of the dispenser shown in FIG. 1 during initial use of the container of disposable wet wipes.

Turning to FIGS. 4 through 7, actual use of the dispenser of the present invention can be demonstrated. A baby wipes package 82 is shown in FIG. 4 prior to entry into the dispenser. This particular package is a soft pack, which can collapse upon removal of the individual wet wipes therein. The upper portion 70 of the package 82 includes a lid 84, which when opened exposes the top wipe of a stacked series of wet wipes contained therein. The lid 84 can thus be juxtaposed within the open area 8 when the upper surface 70 of the package 82 contacts the upper surface 48 of the first portion 10 of the lower member 2. Upon insertion of the package or container as shown in FIG. 5, the upper member 4, and particularly the lower surface 49 of the upper member 4, exerts pressure on the lower surface 86 of the package 82. This pressure not only retains the package between the upper member 4 and the lower member 2, but in conjunction with the downward orientation of the package it causes moisture contained in the package (the moisture provided for the wet wipes, as well as any excess moisture therein) to generally move downwardly towards the top of the container 82 towards the first wet wipe 102 extending therethrough, which is first for removal therefrom, thus maintaining it in a moist condition.

As is discussed above, the presence of a spring 20, or other such means for creating pressure on the upper member 4, can create additional downward force upon the bottom surface 86 of the package 82. It is not necessary to use a spring to accomplish this result, and the weight of the upper member 10 itself, or added weight thereto, can create the same effect. As can thus be seen in FIGS. 6 and 7, as additional wipes 102 are removed from the package 82, the package, which is preferably collapsible and non-rigid, can collapse under the pressure exerted by upper member 4. Thus, as the package decreases in size, the package remains clamped between the upper member 4 and the lower member 2 and all of the advantages of the present invention can continue to be realized. Thus, the distance d between the upper member 4 and the lower member 2 decreases accordingly. Furthermore, the presence of the heater 64 in conjunction with the first portion 10 maintains the individual wipes at a predetermined heated temperature as they are removed from the dispenser. Thus, heated wipes containing the appropriate moisture content are consistently and continuously removed therefrom. The entire dispensing process is thus simplified. In comparison, in a normal configuration when the package is in an upward configuration on a surface and the wipes are withdrawn from the upper portion, the package does not normally collapse, and with each removing wipe it becomes more difficult to grasp a further wipe unless the wipe is extending upwardly through the opening. Furthermore, as discussed above, in those situations the first extending wipe in the upper portion tends to dry out over time, thus diminishing its effectiveness and comfort.

Figure 8:
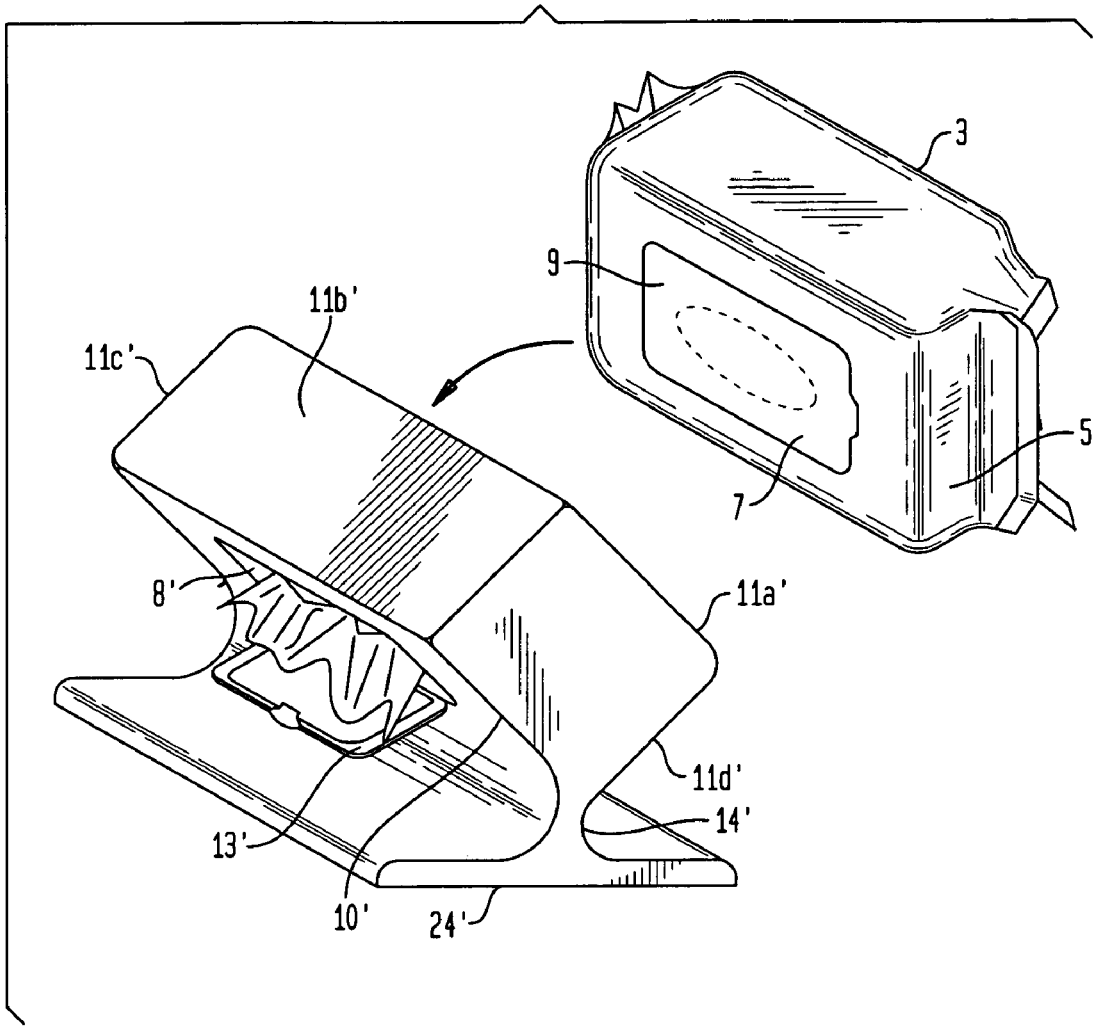
FIG. 8 is a side, perspective view of another embodiment of the dispenser system according to the present invention, in conjunction with a wet wipe holding container.

Turning to FIG. 8, another embodiment of the present invention is shown therein. In this case, the dispenser of the present invention does not include an upper member for pressing downwardly upon the package contained therein. The package shown in FIG. 8 is package 3 as discussed in detail in FIGS. 1*a-c* hereof. As discussed above, this package includes an upper surface 5 which includes a rigid portion 7 containing a snap-open sealable lid 9. The dispensing device in this case once again includes a base 24' in this case, including the neck portion 14' in this case supporting a first member 10' upon which the package will rest in an inverted position. Thus, when the package 3 is inverted and placed onto the top portion of member 10' as shown by the arrow in FIG. 8, the rigid portion 7 will essentially fit within the opening 8' in the portion 10'. It is therefore possible to open snap lid 7 downwardly as shown in FIG. 8, and then remove wet wipes through the dispensing opening 13' in a downward direction as shown in FIG. 8. When not in use, the lid 7 can be closed within the opening 8' to seal the container 3 and maintain the wet wipes in a moist condition.

Figure 9:
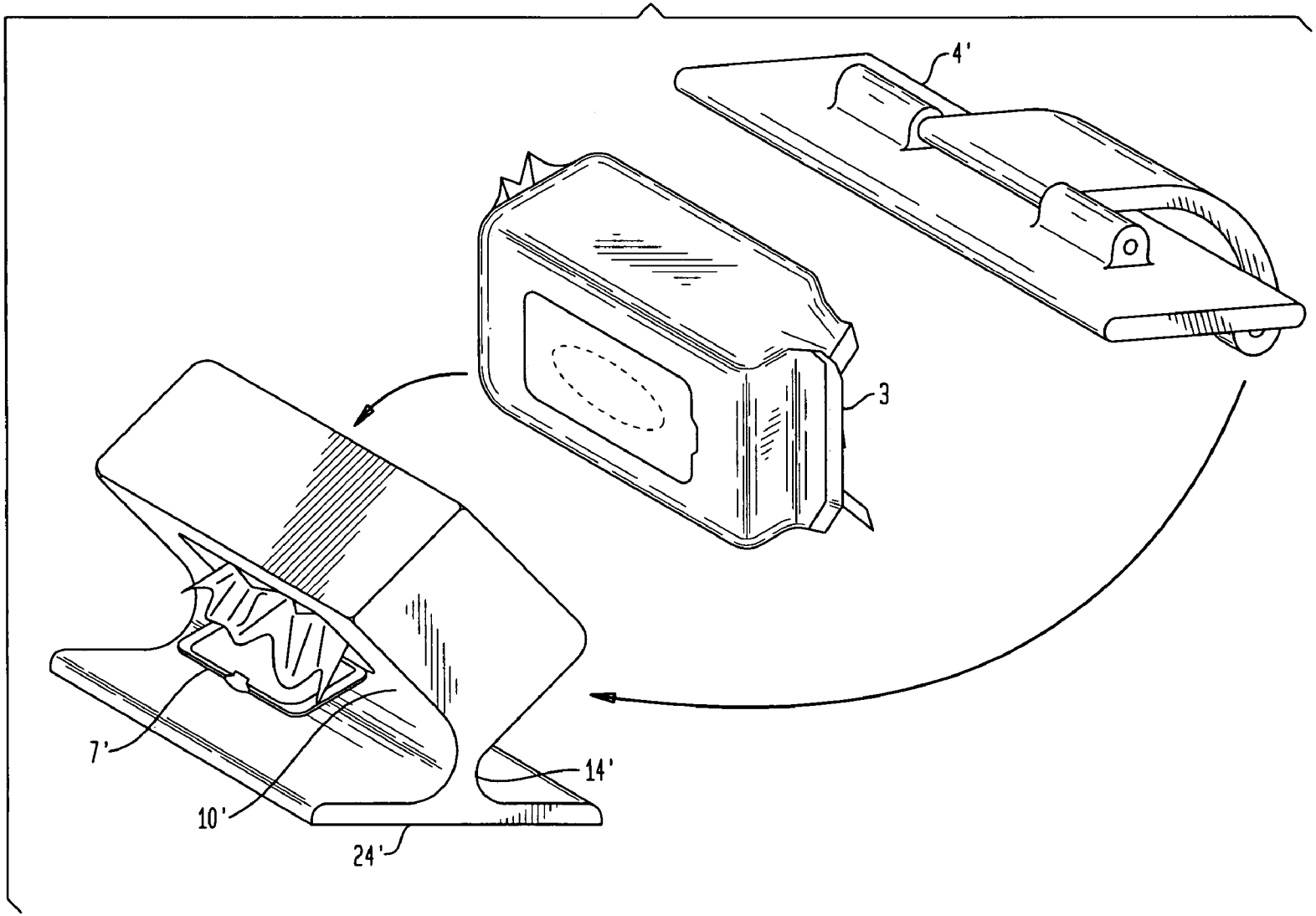
FIG. 9 is a side, perspective, exploded view of yet another embodiment of the dispenser system of the present invention in conjunction with a container therefor.

In the embodiment shown in FIG. 8, the portion 10' includes rectangular wall members 11*a, b, c* and *d*, for further enclosing the container 3 and maintaining it in its desired position. Wall portions 11*a'* through 11*d'* can be shorter or taller, or nonexistent, or the overall construction can be similar to that of the device shown in FIG. 1. Turning to FIG. 9, it can be seen that essentially the same dispenser as shown in FIG. 8 can be modified to include the upper member 4' similar to that shown in FIG. 1.

Figure 10B:
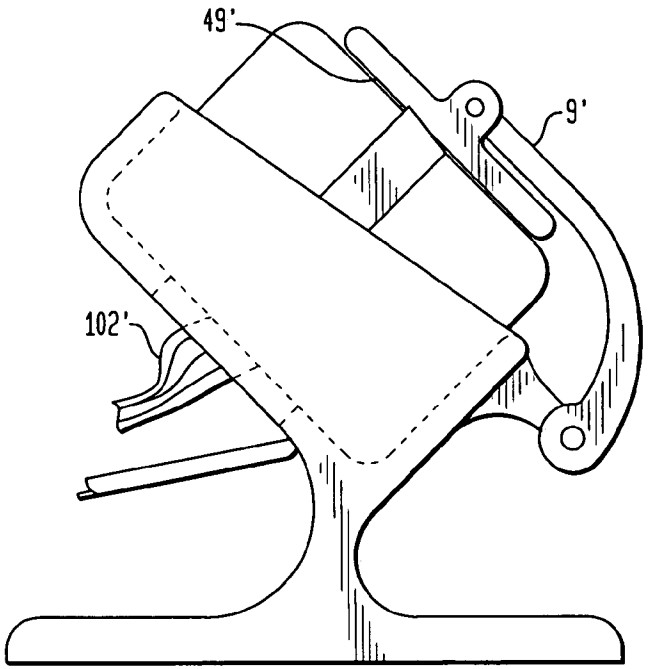
FIG. 10*b* is a side, elevational view of the dispensing system shown in FIG. 10*a* in the use position.
Figure 10A:
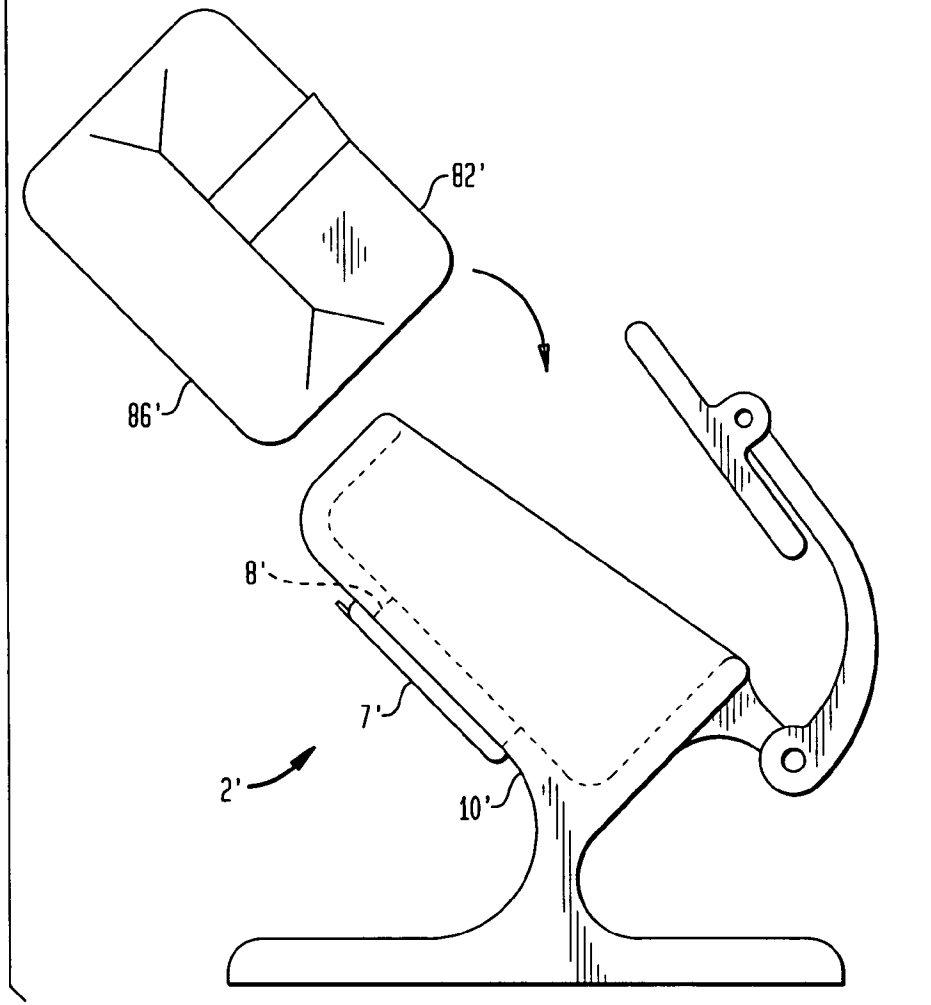
FIG. 10*a* is a side, elevational view of another embodiment of the dispenser system of the present invention in conjunction with a container therefor.
Figure 10D:
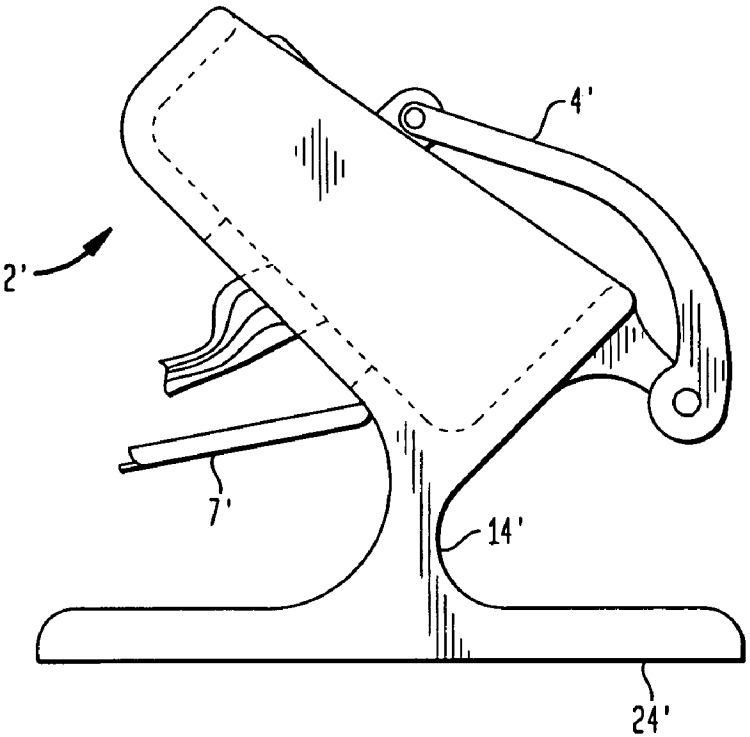
FIG. 10*d* is a side, elevational view of the dispenser system shown in FIG. 10*c* after still further use thereof.
Figure 10C:
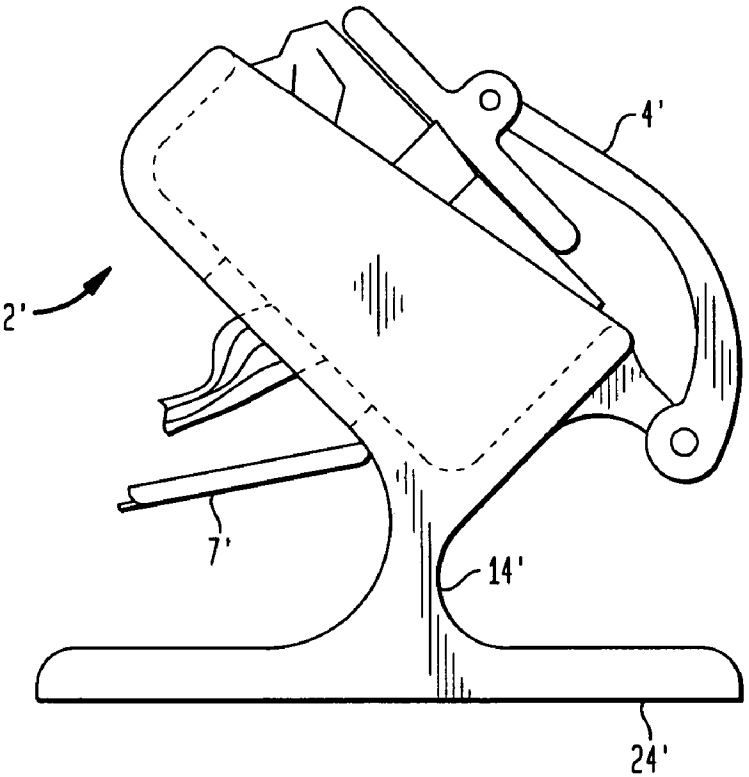
FIG. 10*c* is a side, elevational view of the dispenser system shown in FIG. 10*b* after further use thereof.

Turning to FIGS. 10*a*-10*d*, a device is shown which is similar to that discussed with respect to FIGS. 4-7, but in which the dispenser itself has a configuration similar to that shown in FIGS. 8 and 9. Thus, in this case in actual use a container of wet wipes 82' including a rigid lid 7', similar to that discussed above with respect to FIGS. 8 and 9, is inverted and placed within the device in the method shown in FIG. 10*a* by the arrow therein. The lid 7' can thus be juxtaposed within the open area 8' when the upper surface of the package 82' contacts the upper surface of the first portion 10' of the lower member 2'. Upon insertion of the package or container as shown in FIG. 10B, the upper member 4' and in particular the lower surface 49' thereof exerts pressure on the lower surface 86' of package 82'. This pressure can again not only retain the package between the upper member 4' and the lower member 2', but in conjunction with the downward orientation of the package it causes moisture contained within the package to generally move downwardly towards the top of the container 82' towards the first wet wipe 102' extending therethrough. As can be seen in FIGS. 10*c* and 10*d*, as the number of wet wipes within the container is reduced by removal therefrom, the size of the package decreases, but the upper member 4' continues to press downwardly onto the bottom surface 86' of the package 82' for continued removal and continued maintenance of the moisture of each wet wipe as it is so removed.

Figure 11:
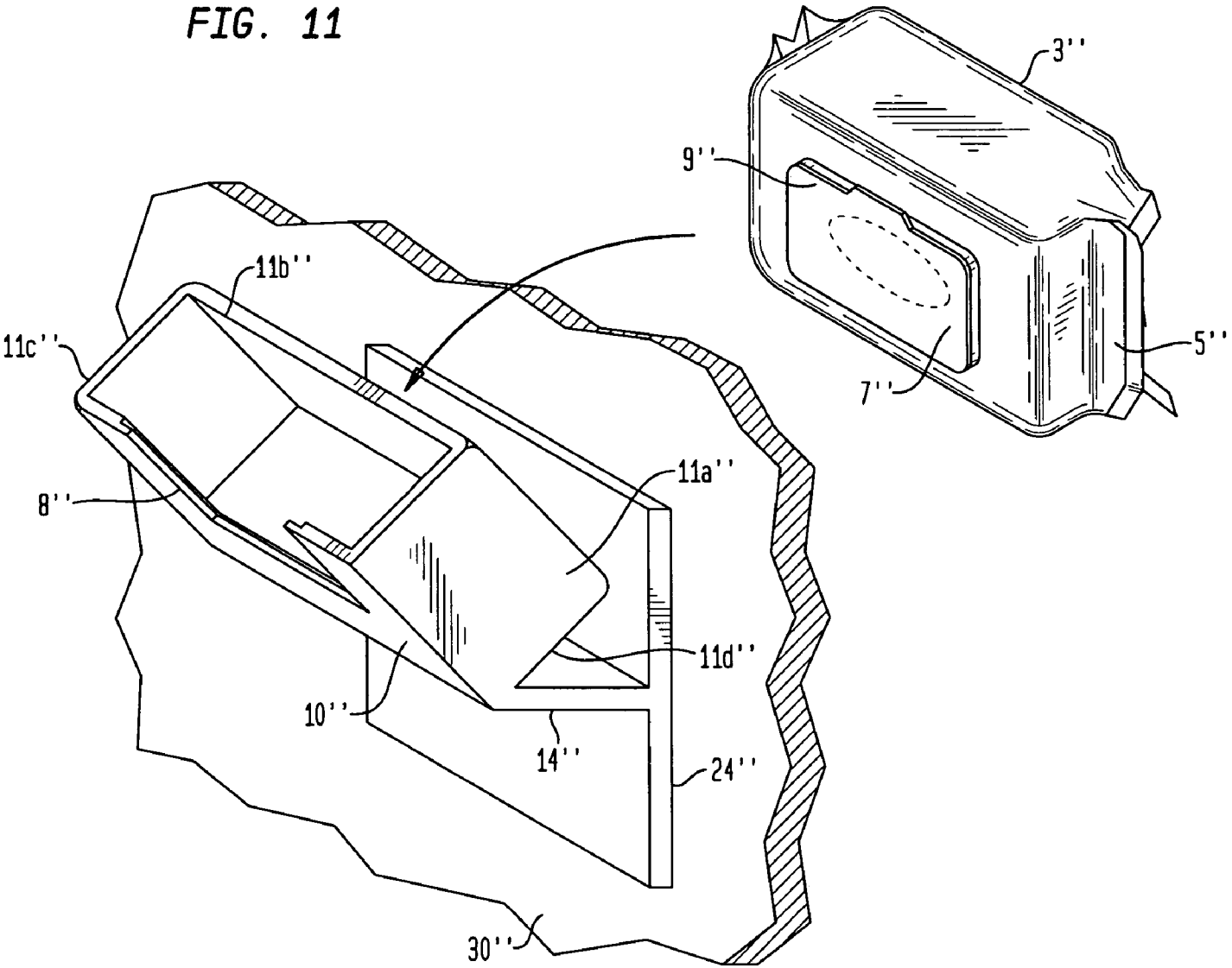
FIG. 11 is a side, perspective view of another embodiment of the dispenser system according to the present invention, in conjunction with a wet wipe holding container.
Figure 12:
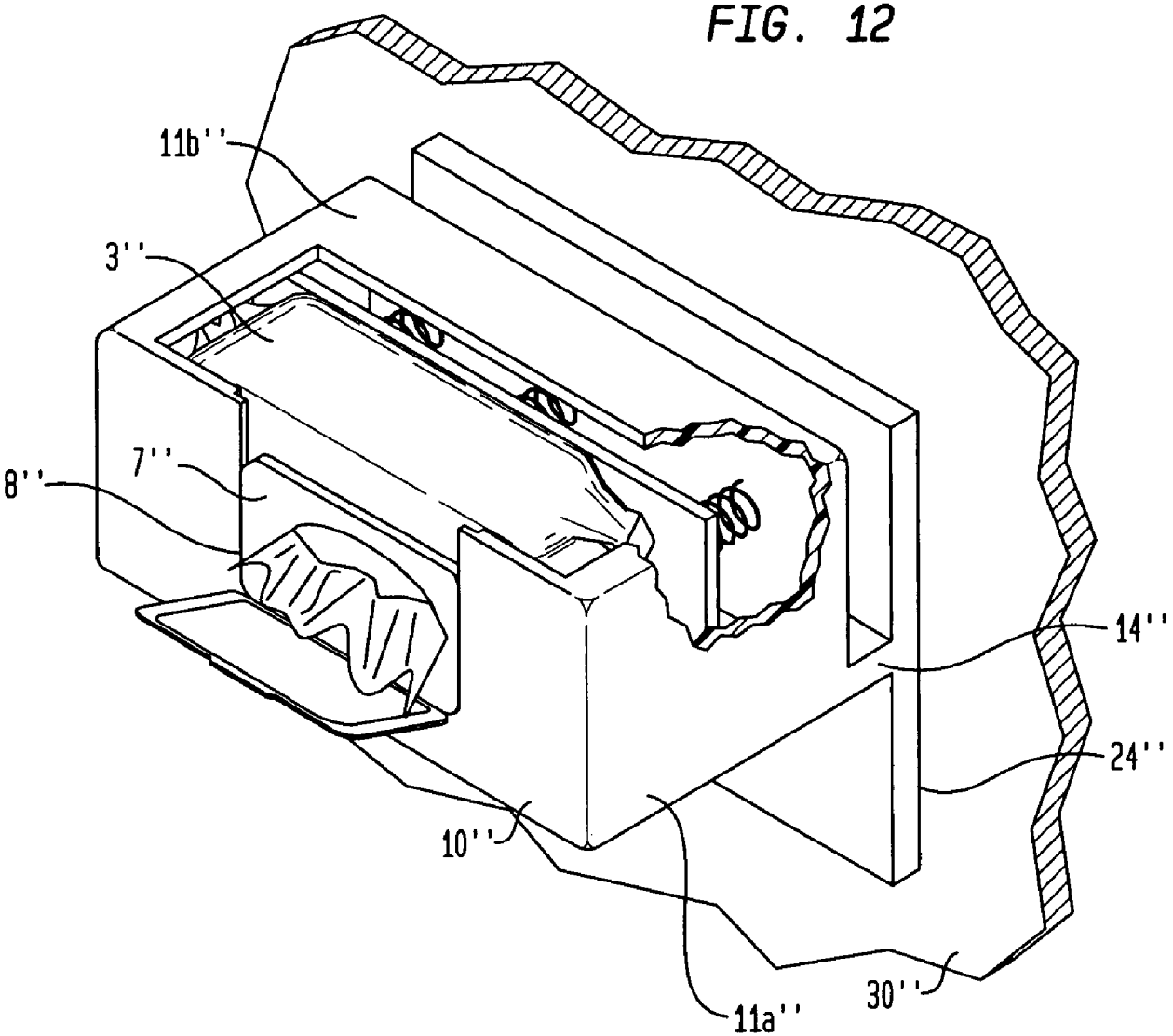
FIG. 12 is a side, perspective, partially sectional view of another embodiment of the dispenser system according to the present invention.

Turning to FIG. 11, yet another embodiment of the present invention is shown therein. In this case, the dispenser of the present invention is adapted for mounting on a substantially vertical surface such as a wall 30". The dispensing device in this case, although similar to the device shown in FIG. 8, employs a base 24" which extends adjacent to the dispensing device so that it extends vertically along the wall 30" to be affixed thereto, either permanently or removably. Affixing of the base 24" to the wall 30" can thus include utilizing glue, screws or nails in any desirable manner. The base 24" includes neck portion 14" which similarly supports first member 10" upon which the package 3" is inverted and placed onto the top portion of member 10" as shown by the arrow in FIG. 11. The rigid portion 7" will thus essentially fit within the opening 8" in the portion 10". The package in this case is the same as the package shown in FIG. 8, and package 3, which is discussed in detail in FIGS. 1*a*-*c* hereof. This package again includes an upper surface 5" including a rigid portion 7" containing a snap-open sealable lid 9". The attachment of neck portion 14" to the bottom wall 11*d"* of the dispenser is at an angle of up to about 70° or 75° in this embodiment. However, as is discussed below with respect to FIG. 12, the angle can be from 0° up to 90° in certain embodiments hereof. In the embodiment shown in FIG. 11, however, in which the angle is up to about 75°, the wet wipes are withdrawn in a generally downward direction. It is also possible for the dispenser to be essentially vertical, in which case the wet wipes are withdrawn horizontally, as is shown in FIG. 12. In this case, the angle between the neck portion 14" and the bottom wall 11*d"* is about 90°. In any event, it is possible in the case of the embodiment of FIG. 11 to open snap lid 9" downwardly, as shown in FIG. 11, and then remove wet wipes through the dispensing opening 13" in a downward direction, as shown in FIG. 11. When not in use the lid 7" can be closed within the opening 8" to seal the container 3" and maintain the wet wipes in a moist condition while mounted on a wall 30" or the like.

Turning to FIG. 12, yet another embodiment of the present invention is shown therein. In this case, the dispenser of the present invention is adapted for mounting on a substantially vertical surface, such as wall 30'. The dispensing device in this case, although similar to the device shown in FIG. 11, in this case the angle between the base 24" and the front and rear faces of the dispensing device itself is about 90°; i.e., so that the wet wipes can be withdrawn substantially horizontally. In this case, the dispenser of the present invention is once again adapted for mounting on a substantially vertical wall 30". This dispensing device once again includes a base 24" which extends vertically along the wall 30" to be affixed thereto, either permanently or removably. The base 24" can be affixed to the wall 30" in the manner discussed above in connection with the embodiment of FIG. 11. In this case, base 24" again includes neck portion 14" which, however, supports front member 10" by being attached to side wall 11*a"* or bottom wall 11*d"*. The package 3" is once again intended to be placed onto the inner surface of front member 10", so that rigid portion 7" will fit within opening 8" in the front portion 10". In this case, in order to be able to insert the package 3" into the dispenser, if the neck portion 14" is long enough, the package 3 could be inserted through an open rear face defined by side walls 11*a"*-11*d"*. However, preferably, side wall 11*b"* can be eliminated entirely, or can be a removable side wall, so that the package 3 can be inserted downwardly into the dispenser therefrom. In that case, the open rear face could be replaced with a solid wall, or where neck portion 14" is short enough, could be left open; i.e., the side walls 11*a"*, 11*c"* and 11*d"* would be close to or actually in contact with base member 24".

Although baby wipes have been discussed throughout this disclosure, it should be understood that the dispenser of the present invention can be operated with various types of materials besides baby wipes. Package contents can include sheets, towels, towelettes, tissues, napkins, or the like. Furthermore, the liquid contained in the package can be various types of liquids, including organic liquids, inorganic liquids, and mixtures thereof. Furthermore, various materials can be used for the construction of the dispenser including metals, plastics, and the like.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A holder for a wet wipe dispenser comprising a support member having an open area whereby the top surface of a container can be juxtaposed with said support member with a raised portion of the container maintained within said open area, and a base portion supporting said support member at a predetermined positive angle with respect to a selected surface on which said base portion is mounted, whereby said support member is disposed at said predetermined positive angle with respect to said selected surface and faces generally in a downward direction when said base portion is mounted on said selected surface and said wet wipes can be individually removed from the container through said open area of said support member and each of said wet wipes is maintained in a moist condition.

2. The holder of claim 1 wherein said wet wipes can be individually removed in a generally downward direction.

3. The holder of claim 2 wherein said base portion is disposed below said support member, whereby said selected surface comprises a substantially horizontal surface.

4. The holderof claim 2 wherein said base portion is disposed adjacent to said support member, whereby said selected surface comprises a substantially vertical surface.

5. The holder of claim 2 wherein said open area has dimensions which substantially correspond to the dimensions of a raised portion of the container.

6. The holder of claim 2 wherein said support member comprises a first support member portion and including a second support member portion substantially perpendicular to said first support member portion, whereby said container can be retained in position between said first support member portion and said second support member portion.

7. The holder of claim 6 wherein said second support member portion comprises a substantially rectangular configuration comprising four wall members for substantially surrounding said container.

8. The holder of claim 2 wherein said support member and said base portion have a unitary construction.

9. The holder of claim 2 including at least one heater for maintaining said wet wipes at a predetermined temperature.

10. The holder of claim 9 including a thermostat for controlling said at least one heater.

11. The holder of claim 9 wherein said at least one heater is disposed in said support member.

12. The holder of claim 9 wherein said at least one heater comprises a resistance heater.

13. The holder of claim 9 wherein said at least one heater comprises a first heater portion on one side of said open area and a second heater portion of a second side of said open area.

14. The holder of claim 13 wherein said first and second heater portions comprise a plurality of heating coils.

15. The holder of claim 9 including actuation means for actuating said heater.

16. The holder of claim 15 wherein said actuation means comprises a switch.

17. The holder of claim 16 wherein said switch is disposed in said support member.

18. The holder of claim 16 wherein said switch is disposed at a location extending into said open area, whereby the presence of the raised portion of the container in said open area actuates said switch.

19. A dispensing system for wet wipes comprising a container including a stacked plurality of wet wipes and having a top surface including a raised area containing a dispensing opening for individual removal of said wet wipes from said container, a support member having an open area whereby said top surface of said container can be juxtaposed with said support member with said raised portion maintained within said open area, and a base portion supporting said support member at a predetermined positive angle with respect to a selected surface on which said base portion is mounted, whereby said support member is disposed at said predetermined positive angle with respect to said selected surface and faces generally in a downward direction and said wet wipes can be individually removed in a generally horizontal or downward direction when said base portion is mounted on said selected surface from said container through said open area of said support member and each of said wet wipes is maintained in a moist condition.

20. The dispensing system of claim 19 wherein said wet wipes can be individually removed in a generally downward direction.

21. The dispensing system of claim 20 wherein said base portion is disposed below said support member, whereby said selected surface comprises a substantially horizontal surface.

22. The dispensing system of claim 20 wherein said base portion is disposed adjacent to said support member, whereby said selected surface comprises a substantially vertical surface.

23. The dispensing system of claim 20 wherein said open area has dimensions substantially corresponding to said predetermined dimensions.

24. The dispensing system of claim 20 wherein said support member comprises a first support member portion and including a second support member portion substantially perpendicular to said first support member portion whereby said container can be retained in position between said first support member portion and said second support member portion.

25. The dispensing system of claim 24 wherein said second support member comprises a substantially rectangular configuration comprising four wall members for substantially surrounding said container.

26. The dispensing system of claim 20 wherein said support member and said base portion have a unitary construction.

27. The dispensing system of claim 20 including at least one heater for maintaining said wet wipes at a predetermined temperature.

28. The dispensing system of claim 27 including a thermostat for controlling said at least one heater.

29. The dispensing system of claim 27 wherein said at least one heater is disposed in said support member.

30. The dispensing system of claim 27 wherein said at least one heater comprises a resistance heater.

31. The dispensing system of claim 27 wherein said at least one heater comprises a first heater portion on one side of said open area and a second heater portion on a second side open area.

32. The dispensing system of claim 31 wherein said first and second heater portions comprise a plurality of heating coils.

33. The dispensing system of claim 27 including actuation means for actuating said heater.

34. The dispensing system of claim 33 wherein said actuation means comprises a switch.

35. The dispensing system of claim 34 wherein said switch is disposed in said support member.

36. The dispensing system of claim 35 wherein said switch is disposed at a location extending into said open area, whereby the presence of said raised portion of said container in said open area actuates said switch.

37. The dispensing system of claim 20 wherein said raised portion of said container includes a closable lid for sealing said dispensing opening.

38. The dispensing system of claim 37 wherein said closable lid comprises a substantially rigid plastic material.

39. A holder for a wet wipe dispenser comprising a support member having an open area whereby the top surface of a container can be juxtaposed with said support member with a raised portion of the container maintained within said open area, a base portion supporting said support member with respect to a selected surface on which said base portion is mounted, and pressure means acting on the bottom surface of the container for urging said wet wipes towards the dispensing opening of the container, whereby as said wet wipes are individually removed from the container the container reduces in size.

40. The holder of claim 39 wherein said pressure means comprises spring means.

41. The holder of claim 39 wherein said support member is disposed substantially vertically whereby said wet wipes are individually removed from said container substantially horizontally.

42. A dispensing system for wet wipes comprising a container including a stacked plurality of wet wipes and having a bottom surface and a top surface whereby a raised area containing a dispensing opening for individual removal of said wet wipes from said container, support means having an open area whereby said top surface of said container can be juxtaposed with said support means with said raised portion mounted within said open area, a base portion supporting said support means with respect to a selected surface on which said base portion is mounted, and pressure means acting on said bottom surface of said container for urging said wet wipes towards said dispensing opening, whereby as said wet wipes are individually removed from said container said container reduces in size.

43. The dispensing system of claim 42 wherein said pressure means comprises spring means.

44. The dispensing system of claim 42 wherein said support means is disposed substantially vertically whereby said wet wipes are individually removed from said container substantially horizontally.

45. A holder for a wet wipe dispenser containing wet wipes stacked within a container having a top surface and a dispensing opening for individual removal of said wet wipes, said dispenser comprising a first member facing generally downwardly and including an open area, a second member above said first member whereby the container can be disposed between said first member and said second member with the dispensing opening in the container juxtaposed with said open area of said first member, and a hinge member interconnecting said first member with said second member for exerting pressure on the container disposed between said first member and said second member, whereby said wet wipes can be individually removed in a generally downward direction from the container through said open area of said first member and moisture within the container is caused to flow towards said open area to moisten each of said individually removed wet wipes.

46. The holder of claim 45 including pressure means acting on said second member for urging said second member towards said first member, whereby as said wet wipes are individually removed from said container and said container reduces in size, said second member remains in contact with and exerts pressure on said container.

47. The holder of claim 46 wherein said pressure means comprises a spring member.

48. The holder of claim 45 wherein said first member includes a first portion including said open area and a second portion substantially perpendicular to said first portion, whereby said container can be retained in position between said first and second portions of said first member.

49. The holder of claim 48 including a base portion supporting said first member.

50. The holder of claim 49 wherein said base portion and said first member have a unitary construction.

51. The holder of claim 45 including at least one heater for maintaining said wet wipes at a predetermined temperature.

52. The dispenser of claim 51 including a thermostat for controlling said at least one heater.

53. The dispenser of claim 51 wherein said at least one heater is disposed in said first member.

54. The dispenser of claim 51 wherein said at lest one heater comprises a resistance heater.

55. The dispenser of claim 51 wherein said at least one heater comprises a first heater portion on one side of said open area and a second heater portion on a second side of said open area.

56. The dispenser of claim 55 wherein said first and second heater portions comprise a plurality of heating coils.

57. The dispenser of claim 51 including activation means for activating said heater.

58. The dispenser of claim 57 wherein said activation means comprises a switch.

59. The dispenser of claim 58 wherein said switch is disposed in said first member.

60. The dispenser of claim 59 wherein said switch is disposed at a location extending into said open area, whereby the presence of said container in said dispenser activates said switch.

61. The dispenser of claim 45 wherein said open area comprises a slot in said first member.

62. A dispensing system for wet wipes comprising a container including a stacked plurality of wet wipes including a top portion having a dispensing opening for individual removal of said wet wipes from said container, and a dispenser comprising a first member facing generally downwardly including an open area, said container disposed on said first member with said top portion of said container in contact with said first member and said dispensing opening juxtaposed with said open area of said first member, a second member disposed above said first member, with said container disposed between said first member and said second member, and a hinge member interconnecting said first member with said second member for exerting pressure on said container, whereby said wet wipes can be removed in a generally downward direction through said open area of said first member and moisture within said container is caused to flow towards said open area to moisten each of said individually removed wet wipes.

63. The dispensing system of claim 62 including pressure means acting on said second member for urging said second member towards said first member, whereby as said wet wipes are individually removed from said container and said container reduces in size, said second member retains contact with and pressure on said container.

64. The dispensing system of claim 63 wherein said pressure means comprises a spring member.

65. The dispensing system of claim 63 wherein said first member includes a first portion including said open area and a second portion substantially perpendicular to said first portion, whereby said container can be retained in position between said first and second portions of said first member.

66. The dispensing system of claim 65 including a base portion supporting said first member.

67. The dispensing system of claim 66 wherein said base portion and said first member comprise a unitary construction.

68. The dispensing system of claim 63 wherein said open area comprises a slot in said first member.

69. The dispensing system of claim 62 including at least one heater for maintaining said wet wipes at a predetermined temperature.

70. The dispensing system of claim 69 including a thermostat for maintaining said heater at said predetermined temperature.

71. The dispensing system of claim 69 wherein said at least one heater is disposed in said first member.

72. The dispensing system of claim 71 wherein said at least one heater comprises a first heater portion on one side of said open area and a second heater portion on the second side of said open area.

73. The dispensing system of claim 72 wherein said first and second heater portions comprise a plurality of heating coils.

74. The dispensing system of claim 71 including actuating means for actuating said heater.

75. The dispensing system of claim 74 wherein said actuating means comprises a switch.

76. The dispensing system of claim 75 wherein said switch is disposed in said first member.

77. The dispensing system of claim 76 wherein said switch is disposed at a location extending into said open area, whereby the presence of said container in said dispenser actuates said switch.

78. The dispensing system of claim 69 wherein said at least one heater comprises a resistance heater.

79. A holder for a wet wipe dispenser comprising a support member having an open area whereby the top surface of a container can be juxtaposed with said support member with a raised portion of the container maintained within said open area, and a base portion supporting said support member at a predetermined angle with respect to a substantially vertical surface on which said base portion is mounted, whereby said support member faces generally horizontally or in a downward direction when said base portion is mounted on said substantially vertical surface and said wet wipes can be individually removed from the container through said open area of said support member and each of said wet wipes is maintained in a moist condition.

80. The holder of claim 79 wherein said wet wipes can be individually removed in a generally downward direction.

81. The holder of claim 79 wherein said open area has dimensions which substantially correspond to the dimensions of a raised portion of the container.

82. The holder of claim 79 wherein said support member and said base portion have a unitary construction.

83. The holder of claim 79 including at least one heater for maintaining said wet wipes at a predetermined temperature.

84. The holder of claim 79 wherein said at least one heater is disposed in said support member.

85. The holder of claim 79 including actuation means for actuating said heater.

* * * * *

UNITED STATES PATENT AND TRADEMARK OFFICE

CERTIFICATE OF CORRECTION

PATENT NO. : 7,252,209 B2
APPLICATION NO. : 10/792067
DATED : August 7, 2007
INVENTOR(S) : Robert P. Julius It is certified that error appears in the above-identified patent and that said Letters Patent is hereby corrected as shown below:

Column 1, line 15, delete “has” and insert therefor --have--.
Column 1, line 41, “case” should read --cases--.
Column 1, line 46, delete “is” and insert therefor --are--.
Column 3, line 26, after “,” insert --the--.
Column 4, line 43, delete “lest” and insert therefor --least--.
Column 7, line 63, delete “which” and insert therefor --when--.
Column 8, line 58, delete “must” and insert therefor --may--.
Column 9, line 31, “95” should read --95ºF--.
Column 13, line 12, “holderof” should read --holder of--.
Column 13, line 19, delete “including” and insert therefor --includes--.
Column 13, line 40, delete “of” and insert therefor --on--.
Column 14, line 21, delete “including” and insert therefor --includes--.
Column 15, line 17, delete “containing” and insert therefor --contains--.
Column 16, line 7, delete “lest” and insert therefor --least--.
Column 17, line 4, delete “69” and insert therefor --70--.

Signed and Sealed this

First Day of July, 2008

JON W. DUDAS
*Director of the United States Patent and Trademark Office*